United States Patent [19]

Mitchell et al.

[11] Patent Number: 4,715,066

[45] Date of Patent: Dec. 29, 1987

[54] SHOULDER PAD

[75] Inventors: Hal D. Mitchell; Donald R. Walker, both of Rolla, Mo.

[73] Assignee: Figgie International Inc., Willoughby, Ohio

[21] Appl. No.: 923,014

[22] Filed: Oct. 24, 1986

[51] Int. Cl.[4] ..... A41D 13/00

[52] U.S. Cl. ..... 2/2

[58] Field of Search ..... 2/2

[56] References Cited

U.S. PATENT DOCUMENTS

| | | | |
|---|---|---|---|
| 2,163,463 | 6/1939 | Kennedy | 2/2 |
| 2,741,767 | 4/1956 | Weeks | 2/2 |
| 3,366,970 | 2/1968 | Morgan | 2/2 |
| 3,721,992 | 3/1973 | Ettinger | 2/2 |
| 3,739,397 | 6/1973 | Truelove | 2/2 |
| 4,320,537 | 3/1982 | Mitchell | 2/2 |
| 4,610,035 | 9/1986 | Mattila | 2/2 |

*Primary Examiner*—Louis K. Rimrodt

*Attorney, Agent, or Firm*—Senniger, Powers, Leavitt and Roedel

[57] ABSTRACT

A shoulder pad for football players and the like. The shoulder pad comprises a left-hand member adapted to fit over the left shoulder and a right-hand member adapted to fit over the right shoulder, each of these members being of generally inverted U-shape as viewed from the side. Each member comprises a chestplate member, a backplate member and an arch member, and the arch members are relatively more rigid than the chestplate members and the backplate members. One chestplate member and one backplate member are fixedly interconnected to each arch member. The arches are laterally spaced to provide an opening for the neck of a wearer with the spacing such that the arches lie adjacent and relatively close to the neck. An additional aspect of this invention includes a method for producing shoulder pads of a range of sizes using arch members of one size.

12 Claims, 5 Drawing Figures

SHOULDER PAD

BACKGROUND OF THE INVENTION

This invention relates generally to shoulder pads for football players and the like and a method for their manufacture, and more particularly to such a shoulder pad which is readily and efficiently manufactured in various sizes with standard parts.

Heretofore, shoulder pads have typically been made of two arch sections which extend partly over the back and chest of the football player, forming an integral chestplate, backplate and arch. While these shoulder pads performed excellently, they require different size arch molds for each size shoulder pad. These molds are typically expensive, and moreover numerous molds require more extensive manufacturing facilities, increasing costs and reducing the productivity of the manufacturing operation.

SUMMARY OF THE INVENTION

Among the several objects of the invention may be noted the provision of an improved shoulder pad, particularly adapted for reducing manufacturing costs. Also, some other objects of this invention are the provision of a shoulder pad and a method of making a shoulder pad which requires fewer mold sizes to produce a variety of size pads, and which provides for the efficient and inexpensive connection of epaulets without sewing.

Generally, a shoulder pad of this invention is particularly adapted for football players and the like. The shoulder pad comprises a left-hand member adapted to fit over the left shoulder and a right-hand member adapted to fit over the right shoulder, each of these members being of generally inverted U-shape as viewed from the side. Each member comprises a chestplate member, a backplate member and an arch member, and the arch members are relatively more rigid than the chestplate members and the backplate members. Connecting means fixedly interconnect one chestplate member and one backplate member to an arch member. The arches are laterally spaced to provide an opening for the neck of a wearer with the spacing such that the arches lie adjacent and relatively close to the neck.

The method of this invention produces shoulder pads of a range of sizes using arch members of one size. The method comprises the steps of (1) selecting two backplate members and two chestplate members of the desired size; (2) fixedly connecting one selected backplate member and one selected frontplate member to the right-side arch member; (3) fixedly connecting the other selected backplate member and the other selected frontplate member to the left-side arch member; and (4) fixedly connecting the backplate members to one another thereby to maintain a lateral space between the right-side members and the left-side members for the neck of a wearer.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENT

Figure 1:
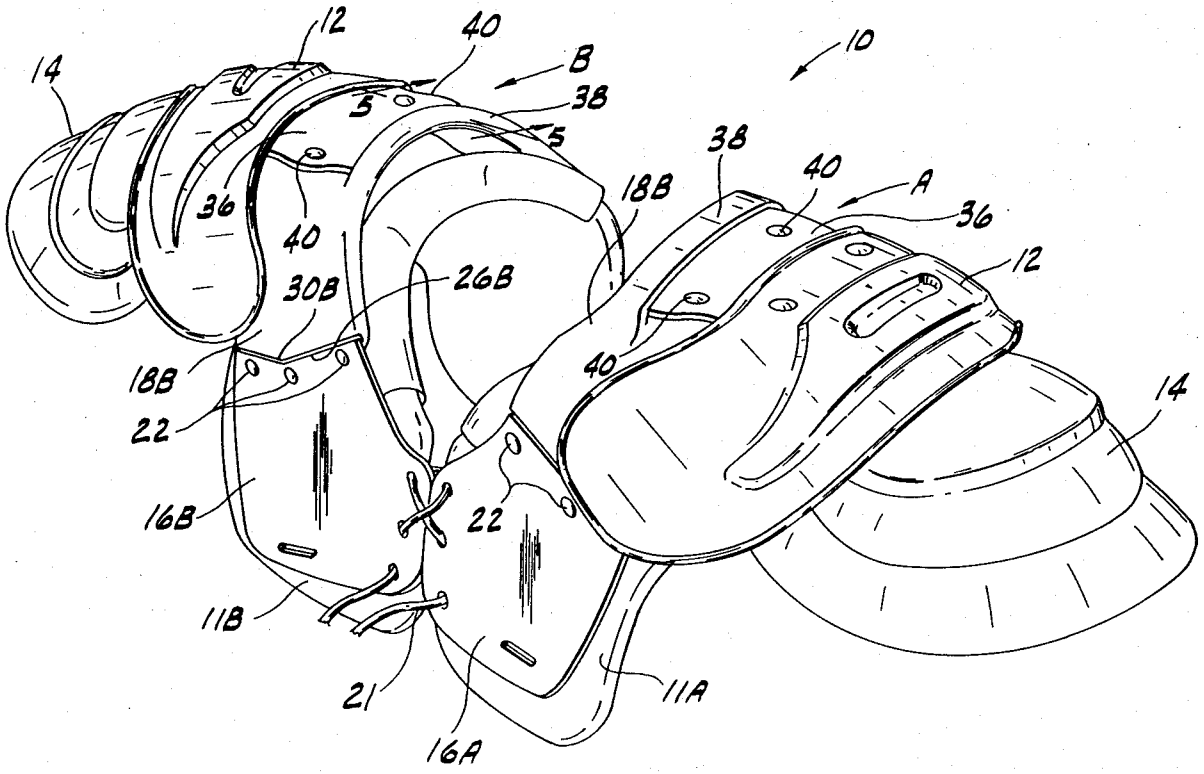
FIG. 1 is a perspective view of a shoulder pad of the present invention.

Now referring to the drawings, a shoulder pad of the present invention is designated in its entirety by the reference numeral 10. As shown in FIG. 1, the shoulder pad comprises a left-hand member generally designated A and a right-hand member generally designated B. Left-hand member A is adapted to fit over the left shoulder of a football player, etc., and right-hand member B is adapted to fit over the right shoulder. For example, left-hand member A and right-hand member B have inner padding sections llA and llB, respectively, which along with the right-hand and left-hand members have a generally inverted U-shape as viewed from the side (see FIG. 1). The shoulder pad may be provided with conventional upper epaulets 12 and outer epaulets 14. Side straps 15 may also be provided for securing the shoulder pads to the shoulders of the football player.

Figure 2:
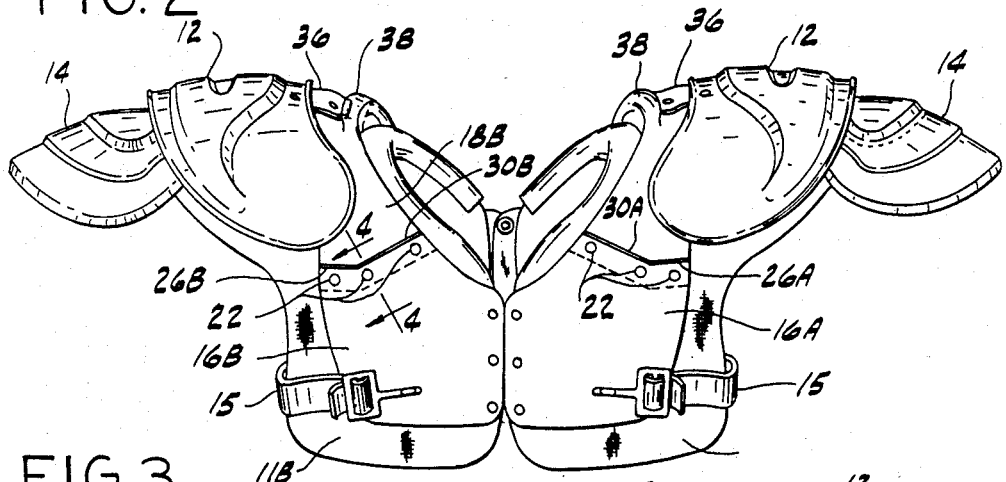
FIG. 2 is a front elevation of the shoulder pad of FIG. 1.
Figure 3:
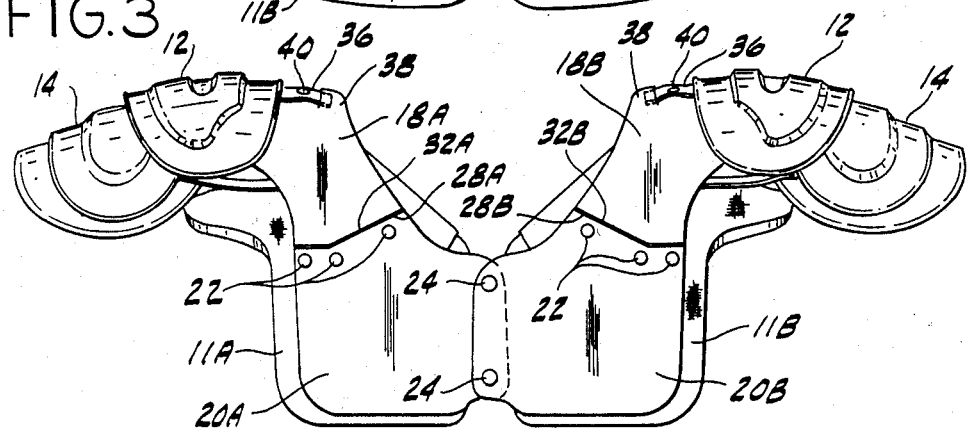
FIG. 3 is a back elevation of the shoulder pad of FIGS. 1 and 2.

As shown in FIG. 2, left-hand member A and right-hand member B include chestplate members 16A and 16B, respectively, and arch members 18A and 18B, respectively. Left-hand member A and right-hand member B also include backplate members 20A and 20B, respectively, as shown in FIG. 3. Preferably, connecting means (e.g., rivets 22) fixedly interconnect the chestplate members 16A, 16B and backplate members 20A, 20B to the arch members.

The arches 18A, 18B are laterally spaced to provide an opening for the neck of a wearer with the spacing such that the arches lie adjacent and relatively close to the neck. For example, rivets 24 may fixedly interconnect the left-hand backplate 20A to the right-hand backplate 20B, thereby maintaining such lateral spacing between the arch members. In addition, conventional laces 21 may be provided for adjustably interconnecting the chestplate members 16A, 16B.

Preferably, chestplate members 16A, 16B have contoured edge portions 26A and 26B, respectively, and backplate members 20A, 20B have contoured edge portions 28A and 28B, respectively. Then arch members 18A, 18B have matingly contoured edge portions 30A and 30B, respectively, adapted for abutting the contoured edge portions 26A and 26B, respectively, of the chestplate members. Arch members 18A, 18B also have matingly contoured edge portions 32A and 32B, respectively, adapted for abutting the contoured edge portions 28A and 28B, respectively, of the backplate members. For example, the contoured edge portions (designated 26A through 32B) may be mating angled portions, or may have a generally V-shaped configuration, as shown in the drawings. A V-shaped configuration is particularly helpful during manufacturing to properly align the members to be connected, and therefore it represents one aspect of the best mode known for this invention. In addition, the arch members preferably have a step configuration at the edge portions 30A, 30B, 32A and 32B, which is helpful for readily and securely attaching the chestplate and backplate members thereto.

Figure 4:
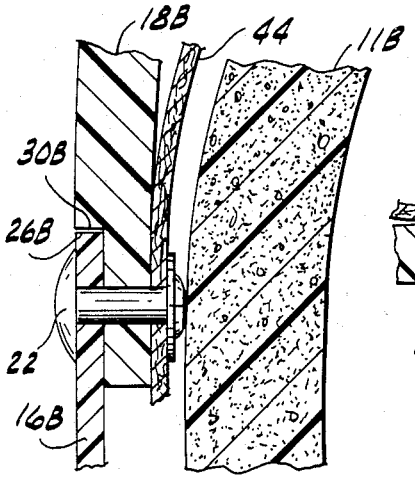
FIG. 4 is an enlarged cross-sectional view along line 4—4 of FIG. 2, showing the interconnection of a front plate member and arch member.

Arch members 18A, 18B may be of molded plastic material, and chestplate members 16A, 16B and backplate members 20A, 20B may be die cut from a sheet of plastic material. As shown in FIG. 4, the arch members may be thicker than the chestplate and backplate members to better resist the greater impacts that they suffer and may be injection or compression molded, depending on the thickness desired. Different size chestplate members and backplate members are used for different sizes of shoulder pads, but a standard arch member size and mold is used for a range of sizes of shoulder pads. This reduces the number of expensive molds required to produce a line of shoulder pads, thereby decreasing the costs associated therewith.

Figure 5:
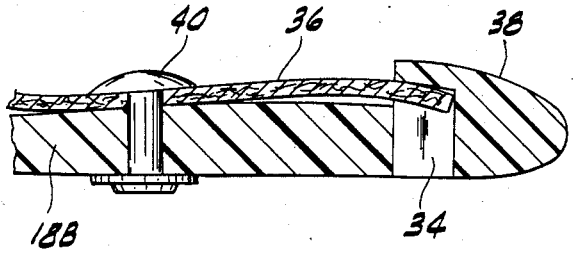
FIG. 5 is an enlarged cross-sectional view along line 5—5 of FIG. 1, illustrating means for receiving a web hinge for an epaulet.

As shown in FIG. 5, each arch member 18A, 18B preferably has means (e.g., a slot 34) for receiving a web hinge 36 of, for example, woven synthetic material, for each upper epaulet 12. The slot is formed in an enlarged inner edge portion 38 in each arch member adjacent the opening for the neck, and the slot has a side opening 39 through which one end of web hinge 36 may pass. Thus web hinge 36 fits inside the inner edge portion, where it is prevented from coming into abrasive contact with a shoulder of the football player wearing it. Web hinges 36 may be securely connected to the arch members 18A, 18B by means of rivets (e.g., two rivets 40 for each web hinge). The slots 34 may be molded into the arch members, thereby decreasing the manufacturing steps required, or alternatively the slots may be cut out of the arch members.

Outer epaulets 14 may be attached to the shoulder pad by web members. For example, one outer epaulet 14 may be attached to a web member (not shown), which in turn is attached to a web strap support arch 44 which spans the shoulder of a wearer and is fastened as by rivets 22 to the chestplate and backplate members to support the shoulder pads in a well known manner. The web member (not shown) attached to the epaulet 14 is perpendicular to the length of the strap 44.

A method for manufacturing shoulder pads of this design for a range of sizes using arch members of one size is recommended. For example, one size of arch members may be used for coat sizes 26 through 30, another for 32 through 36 and another for 38 through 42. (It is understood that other ranges are possible, this example being for purposes of illustration only.) The shoulder pad size would be varied, in this example, by using various chestplate members 16A, 16B and backplate members 20A, 20B, which are adapted for each specific size (e.g., 26, etc.). Therefore, one step in this method is to select two backplate members 20A, 20B and two chestplate members 16A, 16B of the desired size, and another step is to fixedly connect them to the appropriate edge portions 26A, etc. as dislosed above. It should be apparent that this method may provide substantial savings in manufacturing costs and allow a reduction in the manufacturing facilities required to produce shoulder pads. In addition, this method facilitates efficient repair of shoulder pads by minimizing the number of nonstandard parts that make up a shoulder pad.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A shoulder pad for football players and the like comprising a left-hand member adapted to fit over the left shoulder and a right-hand member adapted to fit over the right shoulder, each of said members being of generally inverted U-shape as viewed from the side and comprising a chestplate member, a backplate member and an arch member, said arch member being relatively more rigid than said chestplate member and said backplate member, connecting means for fixedly interconnecting said chestplate member and said backplate member to said arch member, said arches being laterally spaced to provide an opening for the neck of a wearer with the spacing such that said arches lie adjacent and relatively close to the neck.

2. A shoulder pad as set forth in claim 1 wherein said arch members are thicker than said chestplate and backplate members.

3. A shoulder pad as set forth in claim 2 wherein said arch members are molded material and said chestplate members and backplate members are die cut from a sheet of material.

4. A shoulder pad as set forth in claim 3 wherein said arch members, chestplate members and said backplate members are of plastic material.

5. A shoulder pad as set forth in claim 1 wherein said connecting means comprises rivets.

6. A shoulder pad as set forth in claim 1 wherein each chestplate member and each backplate member has a contoured edge portion, each arch member having a matingly contoured edge portion adapted for abutting said contoured edge portion of each chestplate member, and each arch member having a matingly contoured edge portion adapted for abutting said contoured edge portion of each backplate member.

7. A shoulder pad as set forth in claim 6 wherein said contoured edge portions includes mating angled portions.

8. A shoulder pad as set forth in claim 7 wherein each contoured edge portion has a generally V-shaped configuration.

9. A shoulder pad as set forth in claim 1 includes means for receiving a web hinge for an epaulet, the means including a slot defined in the arch member.

10. A shoulder pad as set forth in claim 9 wherein said receiving means includes an inner edge portion adjacent the opening for the neck, one end of the web hinge being inside the inner edge portion.

11. A shoulder pad as set forth in claim 10 wherein said slot is molded into said arch member.

12. A shoulder pad as set forth in claim 1 wherein said right-hand backplate and said left-hand backplate are riveted together thereby to maintain said lateral spacing between the arch members.

* * * * *